United States Patent [19]

Ditchfield

[11] 4,369,881

[45] Jan. 25, 1983

[54] COIL PACKAGE WITH HUB FORMING MEANS CONTAINED THEREIN

[76] Inventor: Neville J. Ditchfield, 19 Gleneagles Close, Vicars Cross, Cheshire, England

[21] Appl. No.: 321,812

[22] Filed: Nov. 16, 1981

[30] Foreign Application Priority Data

Nov. 14, 1980 [GB] United Kingdom ..... 8036601

[51] Int. Cl.[3] ..... B65D 85/04; B65H 55/02

[52] U.S. Cl. ..... 206/225; 206/397; 206/608; 242/170

[58] Field of Search ..... 206/225, 316, 389, 391, 206/392, 394, 395, 396, 397, 408, 409; 242/159, 146, 163, 170, 171

[56] References Cited

U.S. PATENT DOCUMENTS

| | | | |
|---|---|---|---|
| 2,527,401 | 10/1950 | Daoust | 242/170 |
| 2,794,546 | 6/1957 | Miller | 206/397 |
| 2,943,732 | 7/1960 | Kovaleski et al. | 206/389 |
| 3,371,776 | 3/1968 | Voissem | 206/408 |

FOREIGN PATENT DOCUMENTS

| | | | |
|---|---|---|---|
| 538888 | 11/1931 | Fed. Rep. of Germany | 242/159 |
| 1185692 | 4/1959 | France | 206/389 |
| 486933 | 6/1938 | United Kingdom | 206/389 |

*Primary Examiner*—William Price
*Assistant Examiner*—Jimmy G. Foster
*Attorney, Agent, or Firm*—Buell, Blenko, Ziesenheim & Beck

[57] ABSTRACT

A readily stackable coil package comprises a closed carton 1 which is formed from a folded cardboard blank and which has a pair of oppositely disposed major side walls 2 whose boundary edges 4 lie in parallel planes. Each major side wall 2 has an area 5 of weakness in axial alignment with an area of weakness in the other major side wall. A coil of wire is housed in the closed carton 1 and, also loosely housed in the closed carton, is separately formed means 7 for forming a rigid hollow hub. When it is desired to convert the closed carton 1 into a reel, the areas 5 of weakness are removed to form apertures, the separately formed hub forming means 7 is extracted from the package and is assembled to form a rigid hollow hub extending between and secured to parts of the major side walls bounding the apertures in the major side walls.

15 Claims, 10 Drawing Figures

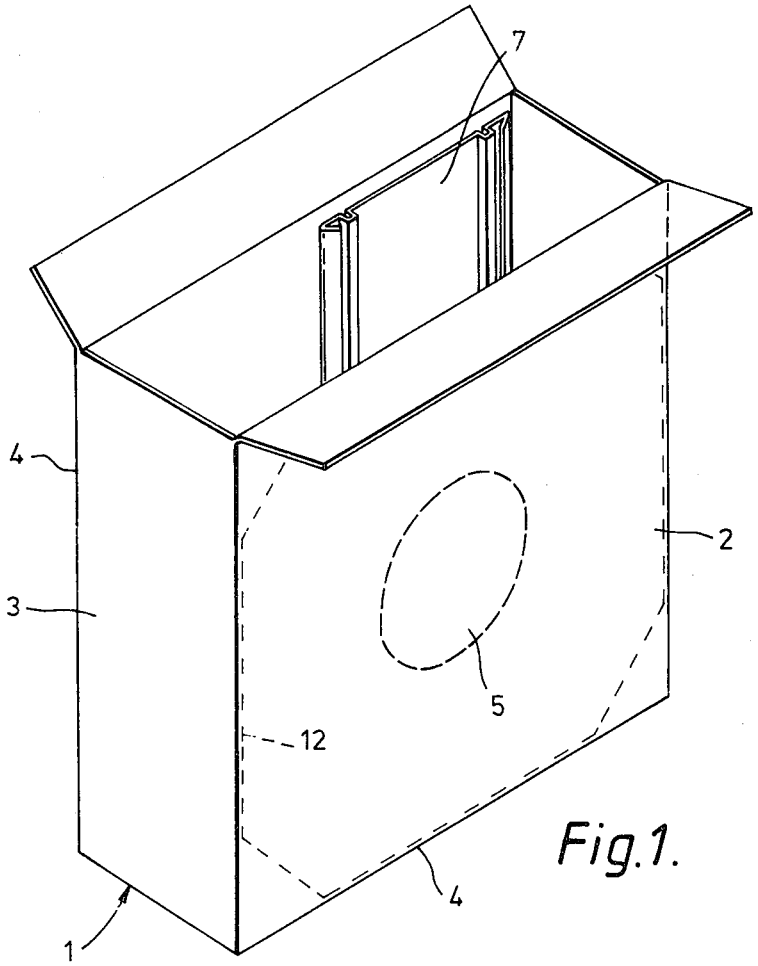
Fig.1.
Fig.8.
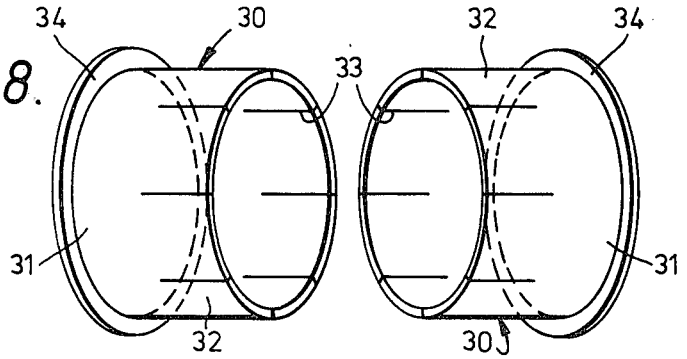

COIL PACKAGE WITH HUB FORMING MEANS CONTAINED THEREIN

This invention relates to the packaging of wire or cable and more particularly to the packaging of coils of bare or insulated electric wire or cable, for example wire or cable of the kinds used in house wiring systems, all such bare and insulated wire and cable hereinafter, for convenience, being included in the generic term "wire".

The interests of the manufacturer, wholesaler or retailer, and user of wire are in conflict insofar as packaging and transportation of wire are concerned. For ease of manufacture and transportation within the factory, it is in the interests of the manufacturer that wire used within the factory be in coil form. From the point of view of the wholesaler or retailer who has to keep a large stock of wires of different kinds from one another, storage of wire is facilitated if it is supplied in packages of a shape and size such that they can be readily stacked. On the other hand, the user prefers wire to be supplied on a reel from which wire can be readily unwound as and when required.

Generally, wire is marketed either in coils which are covered by a toroidal lapping of paper or cheap fabric or on non-returnable reels. The former type of packaging is cheap but it is not popular with wholesalers and retailers because such packaged coils are not readily stackable and it is not popular with users because wire cannot be readily withdrawn from a coil and because once the toroidal lapping is removed to enable wire to be withdrawn from the coil, the balance of the coil is left unprotected and may become tangled, as replacement of the toroidal lapping is usually too tiresome to be undertaken by the user. The alternative form of packing in non-returnable reels in unpopular with the wire manufacturer because it is more costly and is disliked by the wholesaler and retailer because reels cannot be readily stacked.

It is the object of the present invention to provide an improved coil package which serves the dual purposes of a wire carton and reel, which is simple and cheap to manufacture and which can be readily stacked.

According to the invention, the improved coil package comprises a closed carton which is formed from at least one folded blank of cardboard or plastics material and which has a pair of oppositely disposed major side walls whose boundary edges lie in substantially parallel planes, each of which major side walls has an area of weakness in axial alignment with an area of weakness in the other major side wall; a coil of wire housed in the closed carton; and, loosely or detachably housed in the closed carton, separately formed means for forming a substantially rigid hollow hub, the arrangement being such that, when it is desired to convert the closed carton into a reel to facilitate withdrawal of wire from the package, the areas of weakness are removed from the major side walls to form apertures therein, the separately formed hub-forming means is extracted from the package, and the hub-forming means is assembled to form a substantially rigid hollow hub extending between, and secured to parts of the major side walls bounding the apertures in, the major side walls.

It will be appreciated that since, until the areas of weakness in the major side walls are removed and the hub is formed, the coil package is in the form of a closed carton having a pair of oppositely disposed major side walls whose boundary edges lie in substantially parallel planes, transportation and storage of the improved coil packages are facilitated because the closed cartons can be readily stacked.

Preferably, the major side walls of the closed carton are of substantially square or other rectangular shape, although in some cases when space is not at a premium, they may be of octagonal or other non-rectangular shape.

When it is desired to withdraw wire from the reel formed from the closed carton, the outer peripheral wall of the carton extending between the two major side walls is removed so that wire can be readily unwound from the reel by mounting the reel on a spindle or on an arm of the user and drawing wire from the reel. For this purpose, preferably the boundaries between the major side walls and the outer peripheral walls of the carton are perforated or otherwise weakened.

The separately formed means for forming a substantially rigid hollow hub may be loosely or detachably housed in the closed carton in the space bounded by the coil of wire so that it can be extracted from the package through one of the apertures in the side walls, or it may be loosely or detachably housed in the closed carton adjacent the lid of the carton so that it can be extracted by opening the carton lid.

The separately formed means for forming the rigid hollow hub may be made of cardboard, plastics material, metal or metal alloy or any other suitable material and may be secured to the major side walls of the carton in any convenient manner, provided that the operation can be effected without difficulty by a user. In one preferred embodiment, the hub-forming means is a simple flat strip which can be folded or otherwise shaped to form a rigid hollow hub. In another preferred embodiment, the hub-forming means comprises two separately formed parts which, when loosely housed in the closed carton, may be temporarily secured together and which, after they have been removed from the closed carton, can be separated, inserted into the apertures in the major side walls and secured together within the carton to form the hollow hub. Preferably, each of these separately formed parts has a flange or other means at one of its ends for bearing against the outer face of a major side wall; the two separately formed parts may be interconnected at their other ends by a bayonet fitting, a screw threaded connection, a snap fitting or any other suitable connecting means. It will be appreciated that, since the hub is not formed in the carton until wire is to be used, the fact that parts of the hub may protrude beyond the outer surfaces of the major side walls of the carton when the hub is formed is unimportant since, usually, the facility for stacking no longer applies. In some circumstances, however, each of the major side walls of the carton may be of such a dish-like shape, or the aperture in each major side wall may be bounded by a recess of such a depth, that no part of the hub protrudes beyond the planes containing the boundary edges of the major side walls of the carton.

In some circumstances, the two separately formed parts of the hub-forming means may be of such a form that the hub formed therefrom is rotatable with respect to the major side walls of the carton.

The invention is further illustrated by description, by way of example, of two preferred forms of coil package and hubs therefor, with reference to the accompanying drawings, in which:

FIG. 1 is an isometric view of the carton of a first form of coil package showing a hub-forming strip loosely housed therein;

FIG. 8 is a diagrammatic representation of a two-part hub forming means for use with a carton as shown in FIG. 4;

Figure 3:
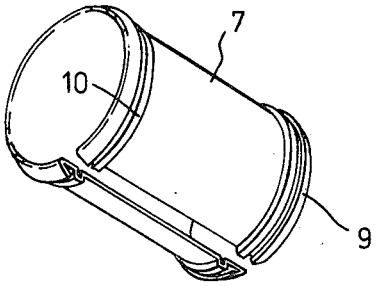
FIG. 3 is an isometric view of the hub-forming strip shown in FIG. 2 in partially rolled form.

Referring to FIGS. 1 to 5, the first preferred form of coil package comprises a carton 1 which is formed from a single folded blank of cardboard and which has a pair of oppositely disposed major side walls 2 and an outer peripheral wall 3 separated by boundary edges 4 which lie in substantially parallel planes. Each major side wall 2 has an area 5 of weakness in axial alignment with an area of weakness in the other major side wall. A coil 6 of wire (for clarity, not shown in FIG. 1) is housed in the carton 1 and, also loosely housed in the carton, is a strip 7 of plastics material for forming a substantially rigid hollow hub 8.

Figure 2:
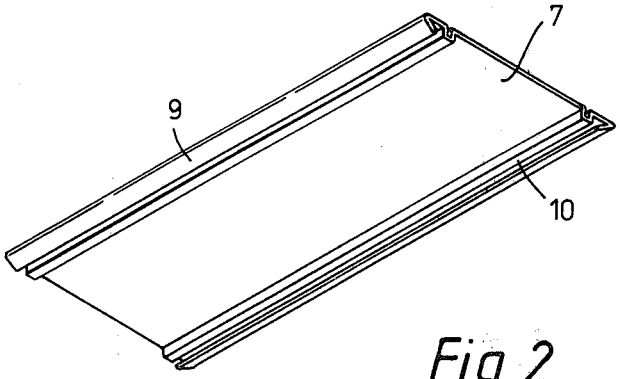
FIG. 2 is an isometric view of the hub-forming strip shown in FIG. 1.

As will be seen on referring to FIG. 2, the plastics strip 7 has, along each of its longitudinally extending edges, a flange 9 which upstands from one surface of the strip and, spaced inwardly from each flange, an upstanding rib 10.

Figure 5:
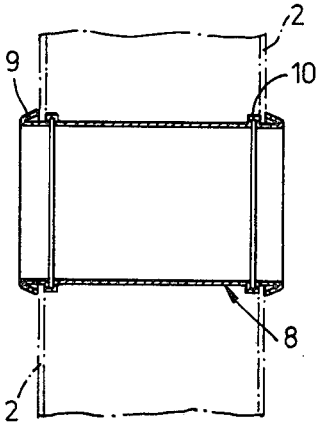
FIG. 5 is an end view, partly in section and partly in elevation, showing the hub-forming strip in position in the carton shown in FIGS. 1 and 4.
Figure 4:
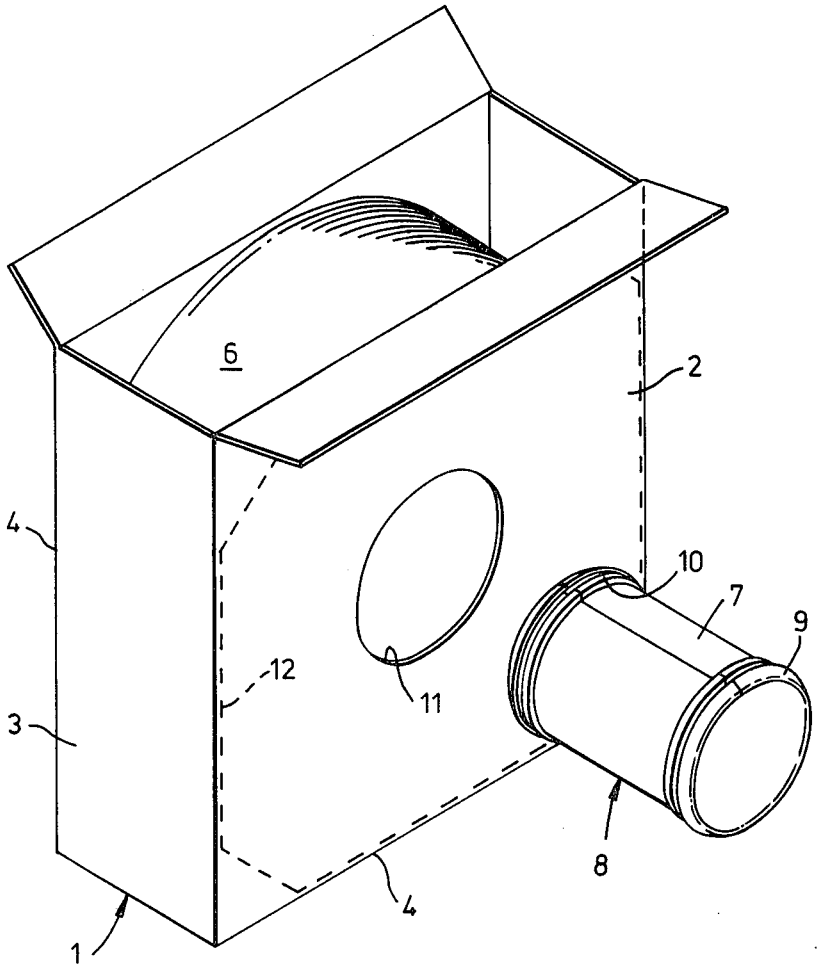
FIG. 4 is an isometric view of the carton shown in FIG. 1, now housing a coil of wire, with apertures formed in its major side walls and with the hub-forming strip fully rolled for insertion into the carton.

When it is desired to convert the carton 1 into a reel to facilitate withdrawal of wire from the package, the area 5 of weakness are removed from the major side walls to form apertures 11 in the walls, the plastics strip 7 is extracted from the package and is rolled as shown in FIGS. 3 and 4 until it is of such a diameter that it will pass through the apertures 11, and the rolled strip is then introduced through the aperture 11 in one major side wall 2 until it protrudes through the aperture 11 in the other major side wall with the flanges 9 bearing against the outer faces of the major side walls and the ribs 10 bearing against the inner faces of the major side walls. The rolled strip 7 is then permitted to partially unroll until it bears against the boundary edges of the apertures 11 as shown in FIG. 5 to form the rigid hub 8. The outer peripheral wall 3 may then be removed by tearing along the continuous perforation 12 extending along the boundary edges 4 and across the corners of each major side wall 2 to form a reel from which wire from the coil 6 can readily be unwound.

Figure 6:
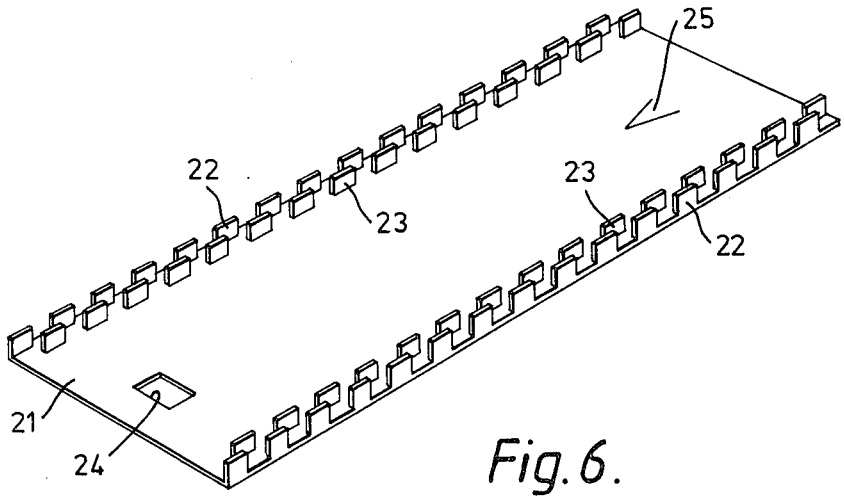
FIG. 6 is an isometric view of a second form of hub-forming strip for use with a carton as shown in FIG. 4.
Figure 7:
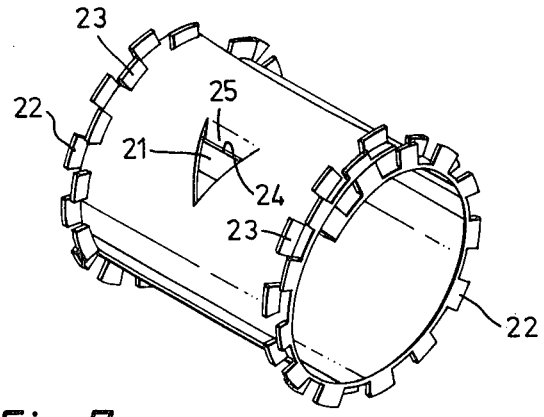
FIG. 7 is an isometric view of the hub-forming strip shown in FIG. 6 in partially rolled form.

The hub-forming strip 21 shown in FIGS. 6 and 7 is made of plastics material and has, along each of its longitudinally extending edges, a plurality of mutually spaced lugs 22 and, spaced inwardly from each row of lugs 22, a row of upstanding mutually spaced lugs 23. Spaced from one end edge of the strip 21 is a hole 24 and spaced from the other end edge is an integral tongue 25. When it is desired to convert the strip 21 into a hub, the strip is rolled as shown in FIG. 7 until the tongue 25 engages in the hole 24 when the rolled strip is of such a diameter that it will pass through the apertures in the major side walls of a carton, and the rolled strip is then positioned in the carton. The strip is then rolled further to disengage the tongue 25 from the hole 24, the rolled strip then unrolling until the lugs 22 bear against the outer faces of the major side walls and the lugs 23 bear against the inner faces of the major side walls.

FIG. 8 shows a two-part hub-forming means made of resilient plastics material, the two parts 30 being substantially identical to one another and comprising an end wall 31 and a circumferential wall 32 upstanding from one face of the end wall and slit longitudinally at each of a plurality of circumferentially spaced positions 33 at the end of the wall 32 remote from the end wall. When a hub is to be formed, each 30 is introduced into the aperture in one of the two major side walls of the carton, the circumferential slits 33 being sufficiently resilient for one wall 32 to engage within or over the other within the carton with the flange 34 of each part 30 bearing against the outer face of a major end wall.

Figure 9:
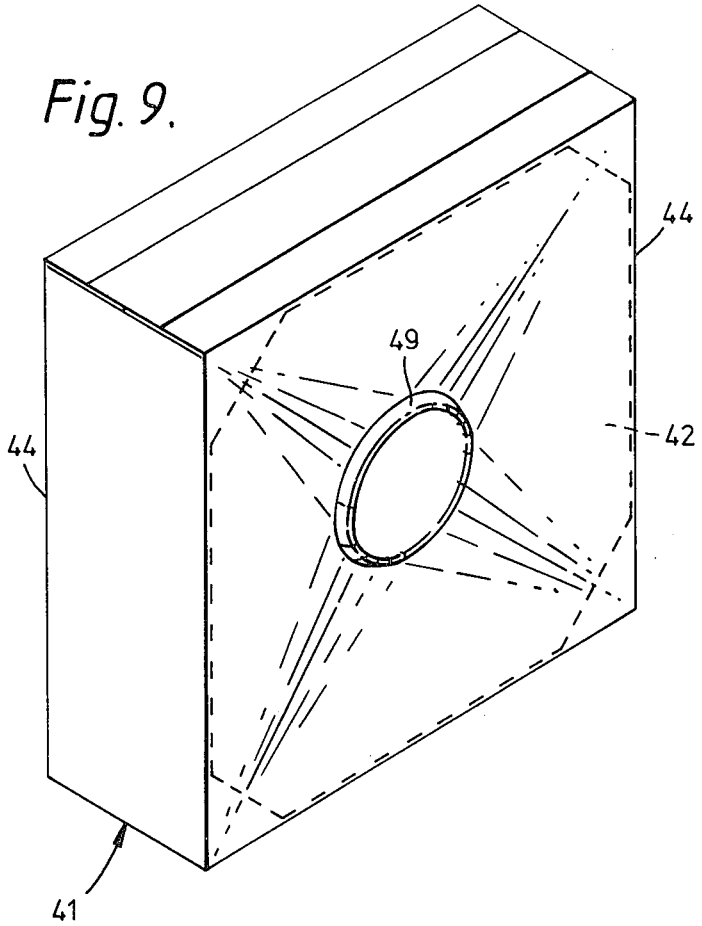
FIG. 9 is an isometric view of a second preferred form of coil package, after assembly.
Figure 10:
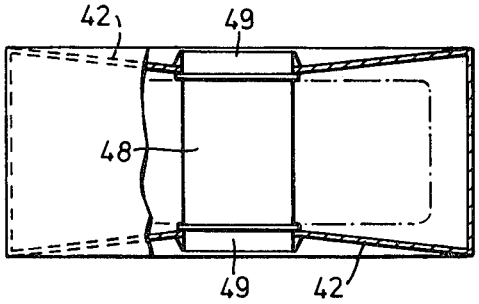
FIG. 10 is an end view, partly in section and partly in elevation, of the coil package shown in FIG. 7.

The second preferred coil package shown in FIGS. 9 and 10 differs from the coil package shown in FIGS. 1 to 5 only in that each major side wall 42 of the carton 41 is of such a dish-like shape that the flanges 49 of the hub 48 bearing against the outer faces of the major side walls 42 do not protrude beyond the planes containing the boundary edges 44 of the major side walls of the carton.

What I claim as my invention is:

1. A coil package comprising a closed carton which is formed from at least one folded blank of cardboard or plastics material and which has a pair of oppositely disposed major side walls whose boundary edges lie in substantially parallel planes, each of which major side walls has an area of weakness in axial alignment with an area of weakness in the other major side wall; a coil of wire housed in the closed carton; and, removably housed in the closed carton, separately formed means for forming a substantially rigid hollow hub, the arrangement being such that, when it is desired to convert the closed carton into a reel to facilitate withdrawal of wire from the package, the areas of weakness are removed from the major side walls to form apertures therein, the separately formed hub-forming means is extracted from the package, and the hub-forming means is assembled to form a substantially rigid hollow hub extending between and secured to parts of the major side walls bounding the apertures in the major side walls.

2. A coil package as claimed in claim 1, wherein the separately formed means for forming a substantially rigid hollow hub is removably housed in the closed carton in the space bounded by the coil of wire so that it can be extracted from the package through one of the apertures in the major side walls.

3. A coil package as claimed in claim 1, wherein the separately formed means for forming a substantially rigid hollow hub is removably housed in the closed carton adjacent a lid of the carton so that it can be extracted by opening the carton lid.

4. A coil package as claimed in claim 1, wherein the hub-forming means is a single flat strip which can be folded to form a rigid hollow hub.

5. A coil package as claimed in claim 4, wherein the flat strip has a flange upstanding along each of its longitudinally extending edges which, when the strip is folded to form a rigid hollow hub, will bear against the outer faces of the major side walls of the carton.

6. A coil package as claimed in claim 5, wherein the flat strip has, spaced from each of its longitudinally extending edges, an upstanding rib which, when the strip is folded to form a rigid hollow hub, will bear against the inner faces of the major side walls of the carton.

7. A coil package as claimed in claim 1, wherein the hub-forming means comprises two separately formed parts which, after they have been removed from the closed carton, can be inserted into the apertures in the major side walls and secured together within the carton to form the hollow hub.

8. A coil package as claimed in claim 7, wherein the two separately formed hub-forming parts, when removably housed in the closed carton, are temporarily secured together and can be readily separated after they have been removed from the carton.

9. A coil package as claimed in claim 7 or 8, wherein each of the separately formed parts of the hub-forming means has a flange at one of its ends for bearing against the outer face of a major side wall.

10. A coil package as claimed in claim 7 or 8, wherein the two separately formed parts of the hub-forming means are of such a form that the hub formed therefrom is rotatable with respect to the major side walls of the carton.

11. A coil package as claimed in any one of claims 5 to 8, wherein each of the major side walls of the carton is of such a dish-like shape that no part of the hub protrudes beyond the planes containing the boundary edges of the major side walls of the carton.

12. A coil package as claimed in claim 1, 4 or 7 wherein the hub-forming means is made of metal or metal alloy.

13. A coil package as claimed in claim 1, 4 or 7, wherein the hub-forming means is made of plastics material.

14. A coil package as claimed in claim 1 wherein the major side walls of the closed carton are of substantially rectangular shape.

15. A coil package as claimed in claim 1, wherein the boundaries between the major side walls and the outer peripheral wall of the carton are perforated.

* * * * *